United States Patent [19]

Litt

[11] Patent Number: 4,798,038

[45] Date of Patent: Jan. 17, 1989

[54] CONTINUOUS BAND AND TRIM SEALING APPARATUS FOR POLY BAGS

[75] Inventor: Irving L. Litt, Rockville Centre, N.Y.

[73] Assignee: All Packaging Machinery & Supplies Corp., Ronkonkoma, N.Y.

[21] Appl. No.: 152,704

[22] Filed: Feb. 4, 1988

[51] Int. Cl.[4] ..... B65B 7/06; B65B 51/18

[52] U.S. Cl. ..... 53/372; 53/373

[58] Field of Search ..... 53/167, 371, 372, 373, 53/379, 393

[56] References Cited

U.S. PATENT DOCUMENTS 3,142,608 7/1964 Techtmann et al. .

3,914,917 10/1975 Young ..... 53/373 X 4,016,026 4/1977 Grevich .

4,723,390 2/1988 Duke ..... 53/372 X

*Primary Examiner*—Robert L. Spruill

*Assistant Examiner*—Ann Tran

*Attorney, Agent, or Firm*—Nolte, Nolte and Hunter

[57] ABSTRACT

A continuous band/trim sealing apparatus for poly bags incorporates an adjustable leveling platform to which support of the flaccid film laminae at open top portions of the bags is directly transferred as ongoing conveying of the bags moves these portions off the supporting surface of a side wing of the apparatus and which guides these portions downstream to the nip of a twin-belt gripping conveyor at the entrance of a band sealing and trimming machine of the apparatus in condition for consistently obtaining flawless band and trim seals.

10 Claims, 7 Drawing Sheets

CONTINUOUS BAND AND TRIM SEALING APPARATUS FOR POLY BAGS

FIELD OF THE INVENTION

This invention relates to conveyorized apparatus for thermally band sealing a superposed pair of thermoplastic film laminae to one another and concomitantly trimming away scrap film from along one side of the band seal.

BACKGROUND OF THE INVENTION

Such apparatus has been provided heretofore, wherein a band sealing and trimming machine is attached as an integral, but separately adjustable, part to a generally horizontally oriented work table in approximately a mid-length table position alongside an endless main conveyor belt motor-driven at production speeds of up to 100 feet per minute on rollers mounted on opposite ends of the work table. An elongated rectangular side wing of the work table has an upper guide surface coplanar with the upper run of the main conveyor belt and extends alongside the belt with its opposite ends respectively near the downstream roller of the belt and a work-receiving mouth of the band sealing and trimming machine. An endless auxiliary conveyor belt, of somewhat greater length and considerably less width than the main conveyor belt, overlies the latter and is motor-driven in synchronism therewith. The common plane of the parallel rotation axes of the end rollers of the auxiliary conveyor belt is at all times perpendicular to the upper run and parallel roller axes of the main conveyor belt, the arrangement being such that the lower side edges of the parallel runs of the auxiliary conveyor belt barely contact the upper run of the main conveyor belt. Thus, in use of the apparatus, the auxiliary belt run facing toward the apparatus side having the attached band sealing and trimming machine will serve as a stop surface to be engaged by the closed bottom end of a poly bag laid upon the main belt upper run and extending onto the table side wing preparatory to the band sealing and trimming of the bag's open end. Selective positioning of the stop surface laterally across the upper run of the main conveyor belt to accommodate various lengths of poly bags is effected by a parallel ruler type of linkage between the work table and a movable frame supporting the end rollers of the auxiliary conveyor belt.

The work table of the known apparatus is moreover mounted on a transportable floor stand in such a manner that the table can be selectively upwardly tilted as much as about 45° from a horizontal orientation about a longitudinal axis running in parallel adjacency to the table side opposite the side of attachment of the band sealing and trimming machine. Thus, an operator standing at the elevated side of the tilted work table will be assisted by gravity in bringing the closed ends of product-filled poly bags into abutting alignment with the stop run of the auxiliary conveyor belt when laying the bags seriatim on the upper run of the main conveyor belt. Their open ends, supported and guided by the side wing of the work table, are transported beyond the downstream end of the side wing until they drop onto an underlying ramp-like entrance guide plate of the band sealing and trimming machine, up which plate they are guided to the nip of a twin-belt gripping conveyor at the mouth of the machine. The twin-belt conveyor, which is driven in synchronism with the main conveyor belt, grips the open end of each bag outboard of where the band seal and trim are to be made, and holds it flat as its ongoing downstream movement brings it between confronting runs of a pair of endless sealing heat transfer bands, each band being trained at its ends about an idler roller and a roller driven to move the band in synchronism with the main conveyor belt. Heater blocks transfer heat through the confronting runs of the bands at a sealing station to form a straight band seal between the film laminae of each bag as the bagged product is conveyed through the sealing station. Directly thereafter, the bag passes through a pressurized air cooling station of the machine to set the band seal, thence through a trimming station of the machine where a cutter wheel trims away the scrap film outboard of the band seal, and finally out of the machine and then off the upstream end of the main conveyor belt into a collecting bin.

As the work table and attached band sealing and trimming machine of the known apparatus are individually adjustable relative to one another in order to accommodate a broad range of bag lengths and widths, a gap must exist between the downstream end of the side wing of the work table and the upstream end of the ramp-like entrance guide plate of the band sealing and trimming machine. This gap is defined by an outboard, downward and downstream offset of the upstream end of the ramp-like entrance guide plate from contiguous alignment with the downstream end of the side wing. The existence of the gap adversely affects the production efficiency of the known apparatus, particularly in respect of the number of poly bags the apparatus can continuously and rapidly provide with virtually perfect band/trim seals in proportion to the number of poly bags actually fed to the apparatus over any given period of time. In this connection, it will be appreciated that the flaccid film laminae at the open ends of the poly bags are deprived of their support by the side wing of the work table when they cross the gap to drop onto the ramp-like entrance guide plate of the band sealing and trimming machine. Hence, the leading corner of the open end of a poly bag being moved along the direction of conveyance will droop somewhat while traversing the gap.

Occasionally, the amount of droop will prevent the corner from intercepting the inclined surface of the entrance guide plate or will effect an interception at an abnormal orientation causing the corner to fold or crumple under a trailing remaining portion of the open end. In either case, the ongoing conveying of the poly bag by the main conveyor belt at best delivers the open end of the bag in distorted condition to the mouth of the twin-belt gripping conveyor, from whence it proceeds in a path between the confronting runs of the sealing heat transfer bands. There results an imperfect band sealing of the open end of the poly bag, in consequence of which the poly bag, when discharged at the downstream end of the apparatus, must be rejected and scrapped.

SUMMARY OF THE INVENTION

An object of the present invention is to improve the above-described known conveyorized apparatus in a manner to ensure continuous, high quality band/trim sealing of all product-filled poly bags presented thereto at production speeds of up to 100 feet per minute.

Another object is to effect such improvement by modifying the structural combination of elements of the known apparatus with a device functioning in cooperation with, and curing the gap difficulty presented by, the side wing of the work table and the ramp-like entrance guide plate of the band sealing and trimming machine.

These objects are achieved by providing, in accordance with the invention, a conveyorized band/trim sealing apparatus for poly bags comprising a generally horizontally oriented elongated work table, a band sealing and trimming machine attached to one longitudinal side of the work table at a mid-length portion of the side, and conveyor means supported by the work table for transporting product-filled poly bags seriatim to and through the band sealing and trimming machine to band seal and trim open ends of the poly bags, the work table having an elongated side wing laterally extending outboard of the one longitudinal side thereof for supporting and guiding the open ends of the poly bags to a transfer region at which the side wing terminates, the band sealing and trimming machine having a ramp-like entrance guide plate beginning in the transfer region at a location therein spaced from the termination of the side wing in outboard, downward and downstream directions so that a three-dimensional gap of non-support for the open ends of the poly bags exists in the transfer region; wherein the side wing is hingedly connected laterally thereof at its termination to a platform providing a longitudinal extension of the side wing, the platform bridging the gap and being movable up and down about the hinged connection, the downward movement of the platform being limited by the inclined surface of the ramp-like entrance guide plate.

Preferably, the hinged connection to the platform is movable over a major portion of the platform length and is releasably lockable to the platform at any selected position to which it is moved within said portion, thereby to adjust the effective length of the platform between its downstream end and the hinged connection.

It is also preferred to provide means coupling the platform to the work table and operative both to move the platform up and down about the hinged connection and to lock the platform at any selected pitch attitude attained in its up and down movement.

According to another aspect of the invention, the platform itself is provided as a separate item suitable for upgrading an existing apparatus of the known character described hereinbefore under the background heading.

DETAILED DESCRIPTION OF THE INVENTION

Figure 1:
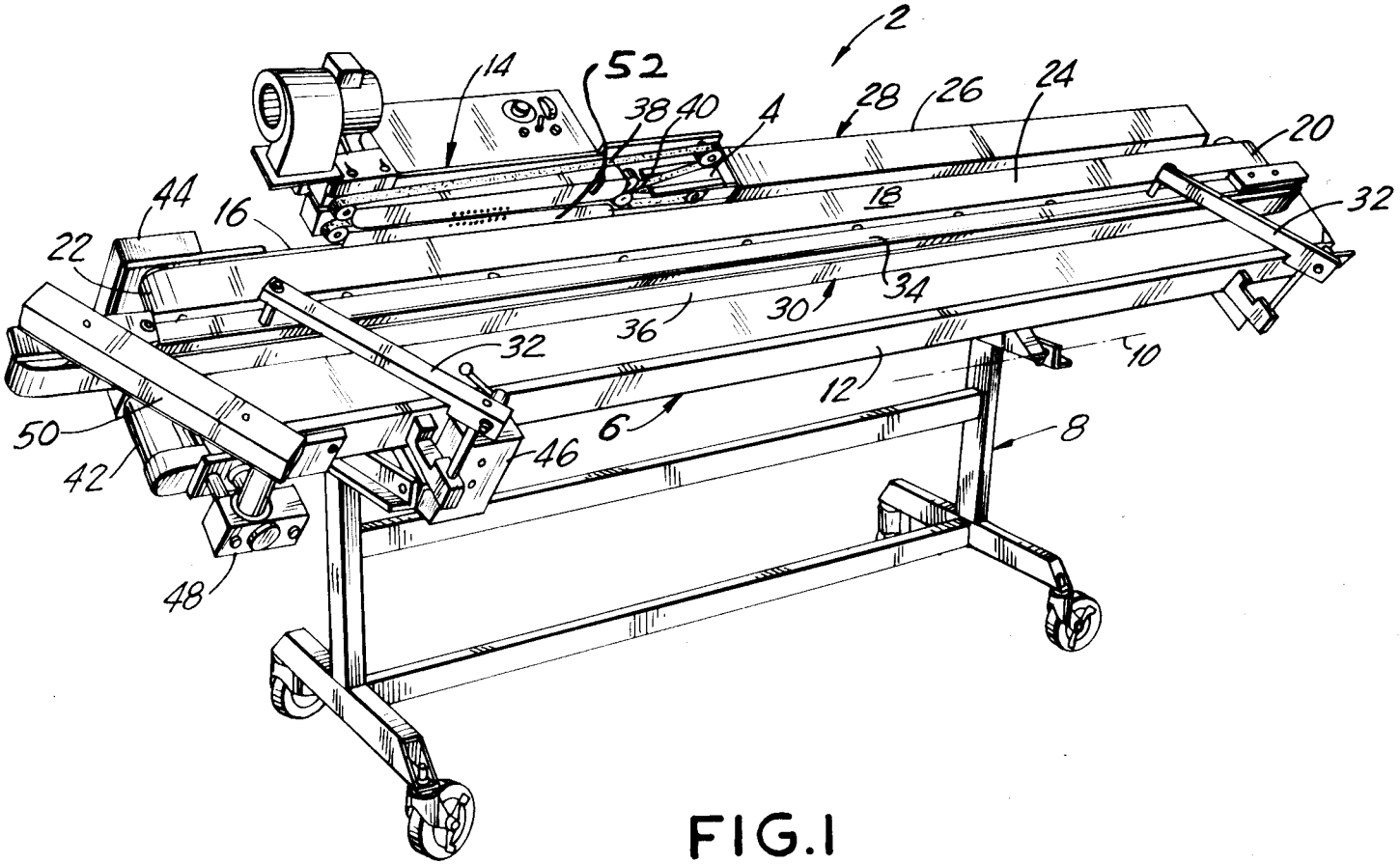
FIG. 1 is a perspective view of a conveyorized apparatus embodying the invention.

FIG. 1 depicts a conveyorized apparatus 2 which, except for including an adjustable leveling platform 4 pursuant to the present invention, is representative of the known apparatus earlier described herein. Thus, only a generalized explanation of FIG. 1 will now be given, with a view to explaining remaining FIGS. 2–7 thereafter in more detail owing to their particular relevance to the improvement effected in the known apparatus in accordance with the present invention.

Accordingly, with reference to FIG. 1, work table 6 of apparatus 2 is shown mounted on transportable floor stand 8 and upwardly tilted approximately 45° about axis 10 which extends in parallel adjacency to one long side 12 of table 6. Band sealing and trimming machine 14 is seen disposed outboard of, and attached to, the other long side 16 of table 6 at approximately a mid-length table position. Motor-driven main conveyor belt 18 covers the length and width of table 6 and is roller supported at its upstream end 20 and its downstream end 22 so that its upper run 24 is coplanar with upper guide surface 26 of work table side wing 28. Auxiliary conveyor belt 30 is shown in a position to which it has been brought about halfway laterally across main conveyor belt 18 by parallel ruler type linkage 32 connected between work table 6 and movable frame 34 of the auxiliary conveyor belt, the relatively narrow runs 36 of auxiliary conveyor belt 30 being at all times perpendicular to upper run 24 of main conveyor belt 18 and having their lower side edges barely contacting the upper run.

Reverting to the showing in FIG. 1 of band sealing and trimming machine 14, one sees at the mouth or entrance thereof the upstream end of twin-belt gripping conveyor 38 and its nip 40. The open end of each poly bag laid on upper run 24 of the driven main conveyor belt 18, with the closed end or bottom of the bag abutting the stop run of auxiliary conveyor belt 30, is initially supported and guided in its downstream travel by side wing 28, thence by adjustable leveling platform 4, directly into nip 40 of gripping conveyor 38. All belts are driven in synchronism by a drive motor 42 via transmissions linked to their drive rollers and contained in housings 44, 46, 48 and 50. Not visible in FIG. 1 is the ramp-like entrance guide plate underlying adjustable leveling platform 4, nor is the three-dimensional gap between the plate's upstream end and the downstream end of side wing 28, which gap is bridged in accordance with the invention by adjustable leveling platform 4. These features will become evident in conjunction with the description hereinafter of FIGS. 3–8. Beforehand, however, reference will be made to FIG. 2 in respect of the interior mechanism of band sealing and trimming machine 14 obscured in FIG. 1 by side covers 52 of machine 14.

Figure 2:
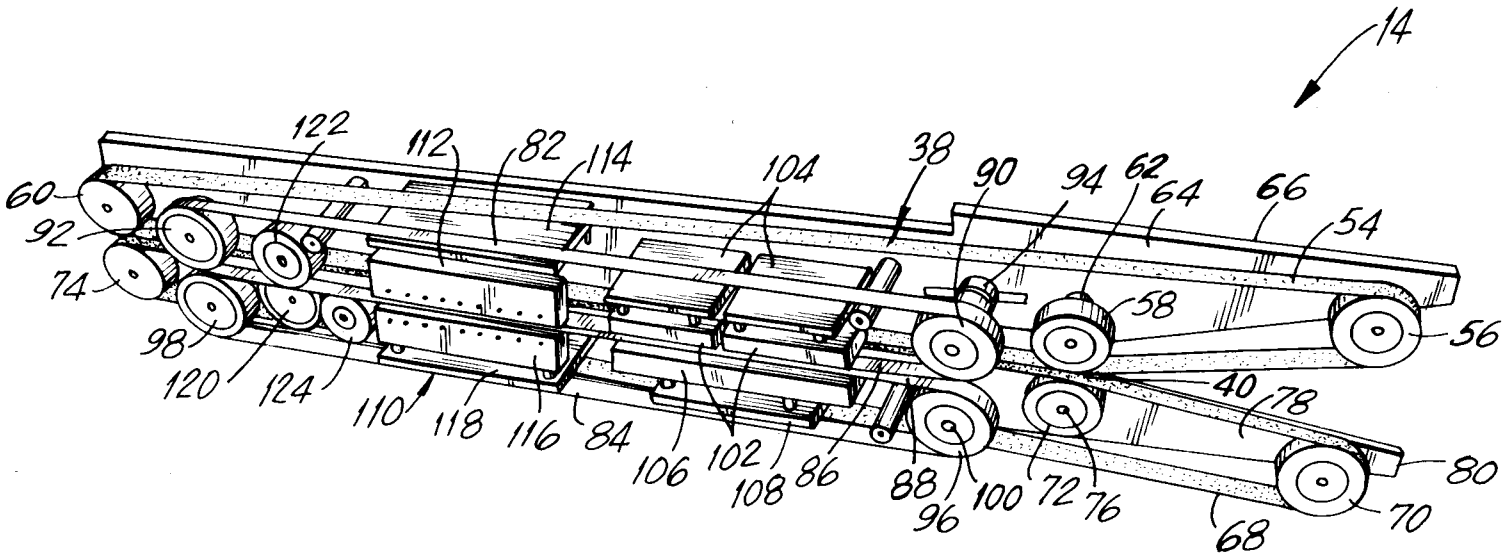
FIG. 2 is a perspective view of the band sealing and trimming machine constituting a component of the FIG. 1 apparatus, the side covers of the machine having been removed to reveal its interior mechanism.

Accordingly, in FIG. 2, twin-belt gripping conveyor 38 is shown with its nip 40 at the mouth of band sealing and trimming machine 14. Upper belt 54 of gripping conveyor 38 is trained about an adjustable upstream roller 56, an idler roller 58 at nip 40 and a downstream drive roller 60, each being rotatably mounted on a respective arbor (e.g., 62) projecting from an inboard facing surface 64 of an upper frame member 66 extending the length of machine 14. In similar fashion, lower belt 68 of gripping conveyor 38 is trained about an adjustable upstream roller 70, an idler roller 72 at nip 40 and a downstream driver roller 74, each being rotatably mounted on a respective arbor (e.g., 76) projecting from an inboard facing surface 78 of a lower frame member 80 extending the length of machine 14. Inboard surfaces 64 and 78 are coplanar.

With further reference to FIG. 2, there are shown an upper endless sealing heat transfer band 82 and a lower endless sealing heat transfer band 84, the bands 82 and 84 being of PTFE and having respective runs 86 and 88 confronting one another. Upper band 82 is trained about an adjustable upstream roller 90 and a downstream drive roller 92, each being rotatably mounted on a respective arbor (e.g., 94) projecting from surface 64 of upper frame member 66, whilst lower band 84 is trained about an adjustable upstream roller 96 and a downstream drive roller 98, each being rotatably mounted on a respective arbor (e.g., 100) projecting from surface 78 of lower frame member 80. Band roller pair 92, 98 is slightly upstream and inboard of gripping conveyor roller pair 60, 74; and band roller pair 90, 96 is slightly downstream and inboard of gripping conveyor roller pair 58, 72. For band sealing a poly bag where its open end is disposed between confronting runs 86, 88 as the bag is conveyed through machine 14, sealing heat is transferred to the bag laminae through run 86 of upper band 82 from a side-by-side pair 102 of overlying heater blocks depending from respective mounting brackets 104 and is simultaneously transferred to the bag laminae through run 88 of lower band 84 from an underlying heater block 106 supported on a mounting bracket 108. The resulting band seal is set and the portions of confronting runs 86, 88 contiguous thereto are cooled as the continuing conveyance of the poly bag carries the band seal through a pressurized air cooling station 110 immediately downstream of heater blocks 102, 106. At station 110, the band seal passes between an upper pressure block 112 which depends from a mounting bracket 114 and a lower pressure block 116 which is supported on a mounting bracket 118. Thereafter, the ongoing downstream travel of the poly bag carries it through a trimming station 120, 122, 124 comprising a steel circular cutting blade 120 cooperating with acetal resin rollers 122 and 124 to trim away film laminae of the poly bag outboard of the band seal.

Figure 3:
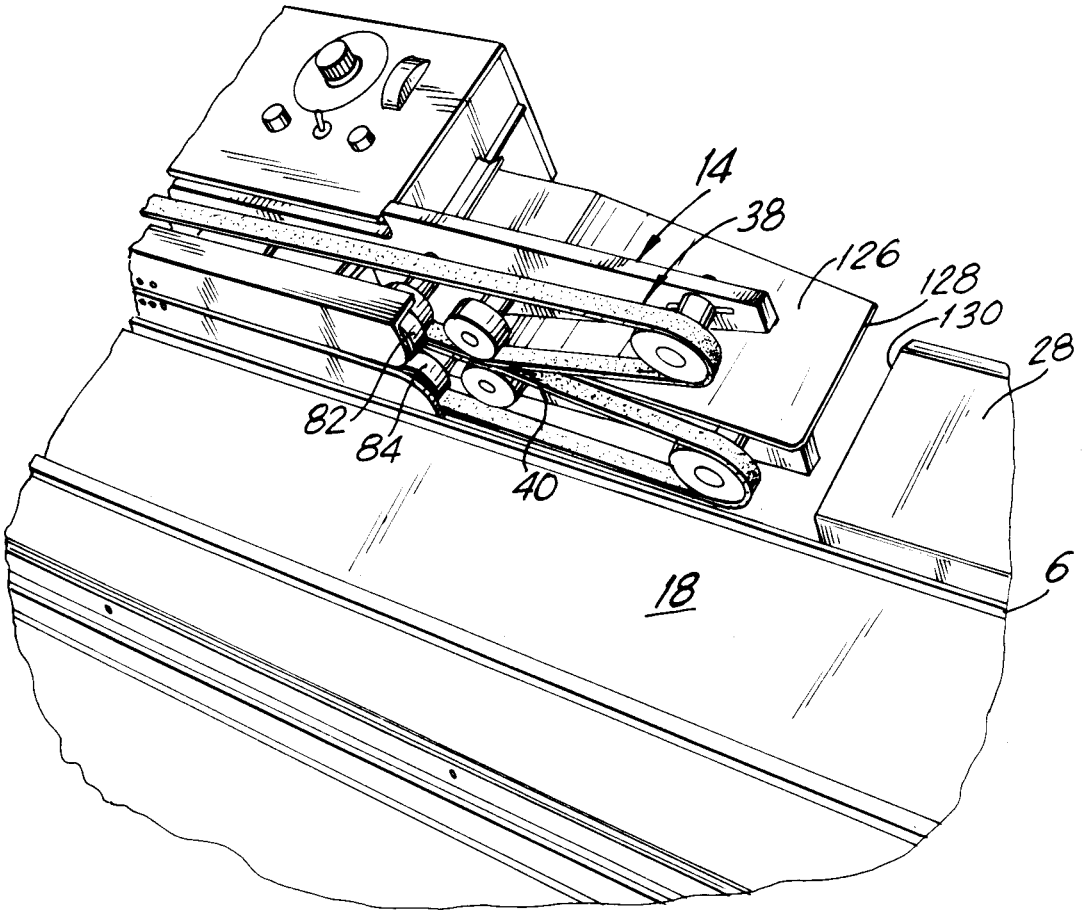
PRIOR ART FIG. 3
FIG. 3 is a close-up view in perspective of the bag transfer region between the work table side wing and the band sealing and trimming machine as such region would appear in the FIG. 1 apparatus absent the invention.
Figure 4:
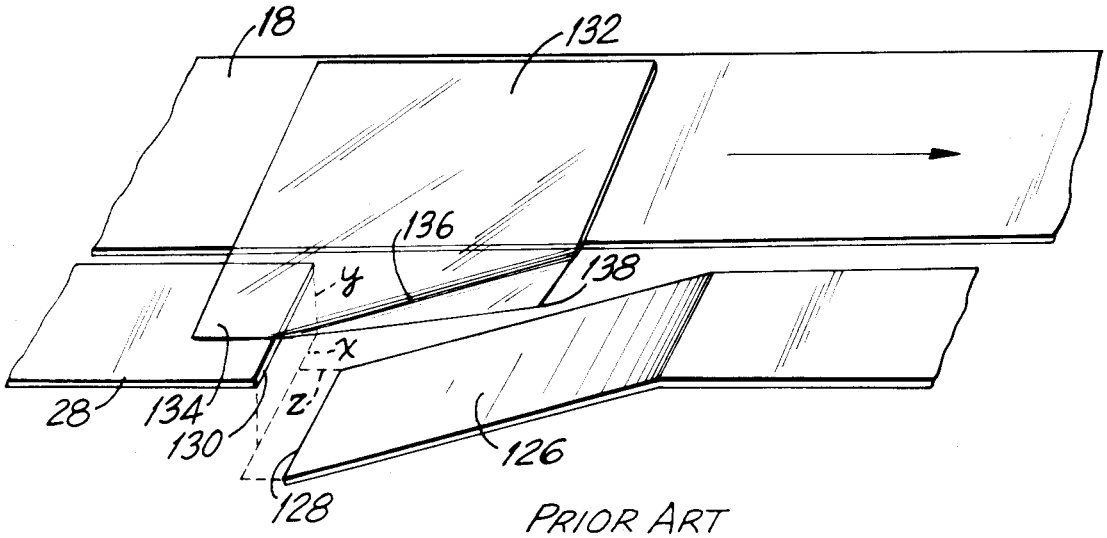
PRIOR ART FIG. 4
FIG. 4 is a schematic representation of a flaccid poly bag being conveyed through the region shown in FIG. 3 and, as a consequence thereof, undergoing a drooping distortion of its open top.

FIGS. 3 and 4 illustrate the source and nature of the problem solved by the present invention; whereas FIG. 5 and FIGS. 6–8 serve to illustrate the source cured of the problem by means of the invention and details of the curative means.

From the close-up view in FIG. 3 of the bag transfer region between side wing 28 of work table 6 and band sealing and trimming machine 14 of conveyorized apparatus 2 (without the adjustable leveling platform 4 shown in FIG. 1), it is seen that machine 14 has a ramp-like entrance guide plate 126 for the open ends of poly bags, the plate leveling off at nip 40 of twin-belt gripping conveyor 38. The upstream end 128 of guide plate 126 has an outboard, downward and downstream offset from contiguous alignment with the downstream end 130 of side wing 28, as more clearly indicated in FIG. 4 by respective characters x, y and z. Such offsets define a three-dimensional gap between downstream end 130 of side wing 28 and upstream end 128 of guide plate 126 necessitated by the individual adjustability of work table 6 and machine 14 relative to one another to accommodate a broad range of poly bag lengths and widths. The gap, however, creates a problem, the nature of which is illustrated by the showing in FIG. 4 of a flaccid poly bag 132 at a stage of its continuous movement downstream by main conveyor belt 18 where a trailing portion 134 of its open end is supported on side wing 28 and the remaining leading portion is unsupported causing the leading portion to droop towards guide plate 126 substantially along a line 136 between conveyor 18 and downstream end 130 of side wing 28. The droop in combination with outboard offset x may prevent the corner 138 of the leading portion from intercepting guide plate 126, or the droop alone may bring about an interception at an angle causing corner 138 to crumple under itself. In either case, the open end of poly bag 132, at best, would be conveyed in distorted condition to nip 40 of twin-belt gripping conveyor and thence in such condition to sealing heat transfer bands 82, 84, thereby to result in imperfect band sealing of the open end of poly bag 132 and consequent scrapping of the bag. This problem is cured, in accordance with the invention, by means first shown close-up and as applied in FIG. 5 and then in structural detail in FIGS. 6–8, now to be described.

Figure 5:
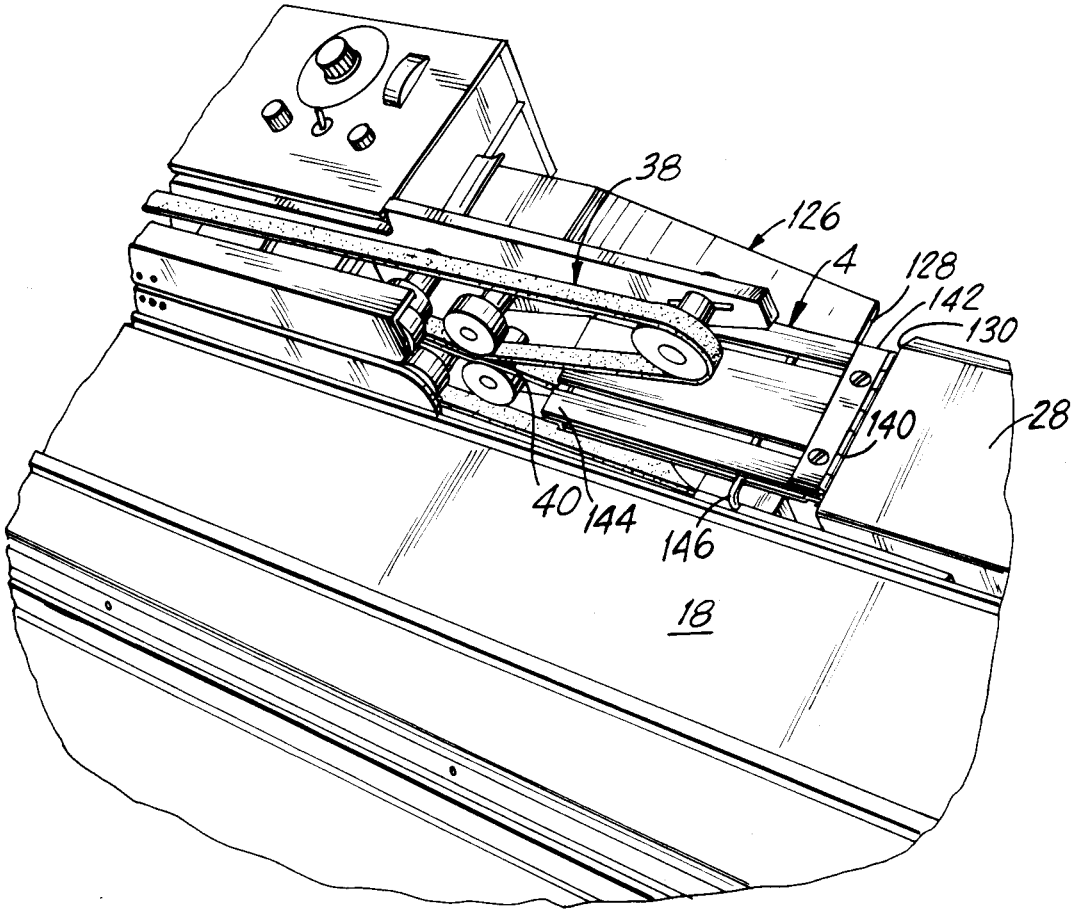
FIG. 5 is a close-up view similar to that of FIG. 3, except for depicting the bag transfer region as it in fact appears in the FIG. 1 embodiment of the invention; and, FIGS. 6, 7 and 8 are plan, elevational and end views, respectively, of an adjustable leveling platform in accordance with the invention, each view including indications in phantom outline of the platform's cooperation with other structural integers of the FIG. 1 apparatus.

FIG. 5 adds adjustable leveling platform 4 (FIG. 1) to FIG. 3, thereby to show the advantageous cooperation of platform 4 with side wing 28 and ramp-like entrance guide plate 126 by which the problem presented by the three-dimensional gap between downstream end 130 of side wing 28 and upstream end 128 of guide plate 126 is cured. Platform 4 extends over the gap from a hinged connection 140 of the platform to side wing 28, the connection being contiguous with the upstream end 142 of the platform and downstream end 130 of the side wing. Platform 4 is thus movable up and down about hinged connection 140 and, as shown in FIG. 5, has been adjusted to a level which brings its downstream end 144 in position to direct a moving poly bag's open end supported thereby into nip 40 of twin-belt gripping conveyor 38. Downward movement of platform 4, of course, is limited by its downstream end 144 coming into contact with the underlying surface area of ramp-like entrance guide plate 126. A rod 146 forming part of a level adjusting arrangement is partially seen in FIG. 5 extending laterally beneath an upper surface of platform 4, and such arrangement will now be more fully described, together with an arrangement for adjusting the effective length of platform 4, both in conjunction with FIGS. 6–8.

Figure 6:
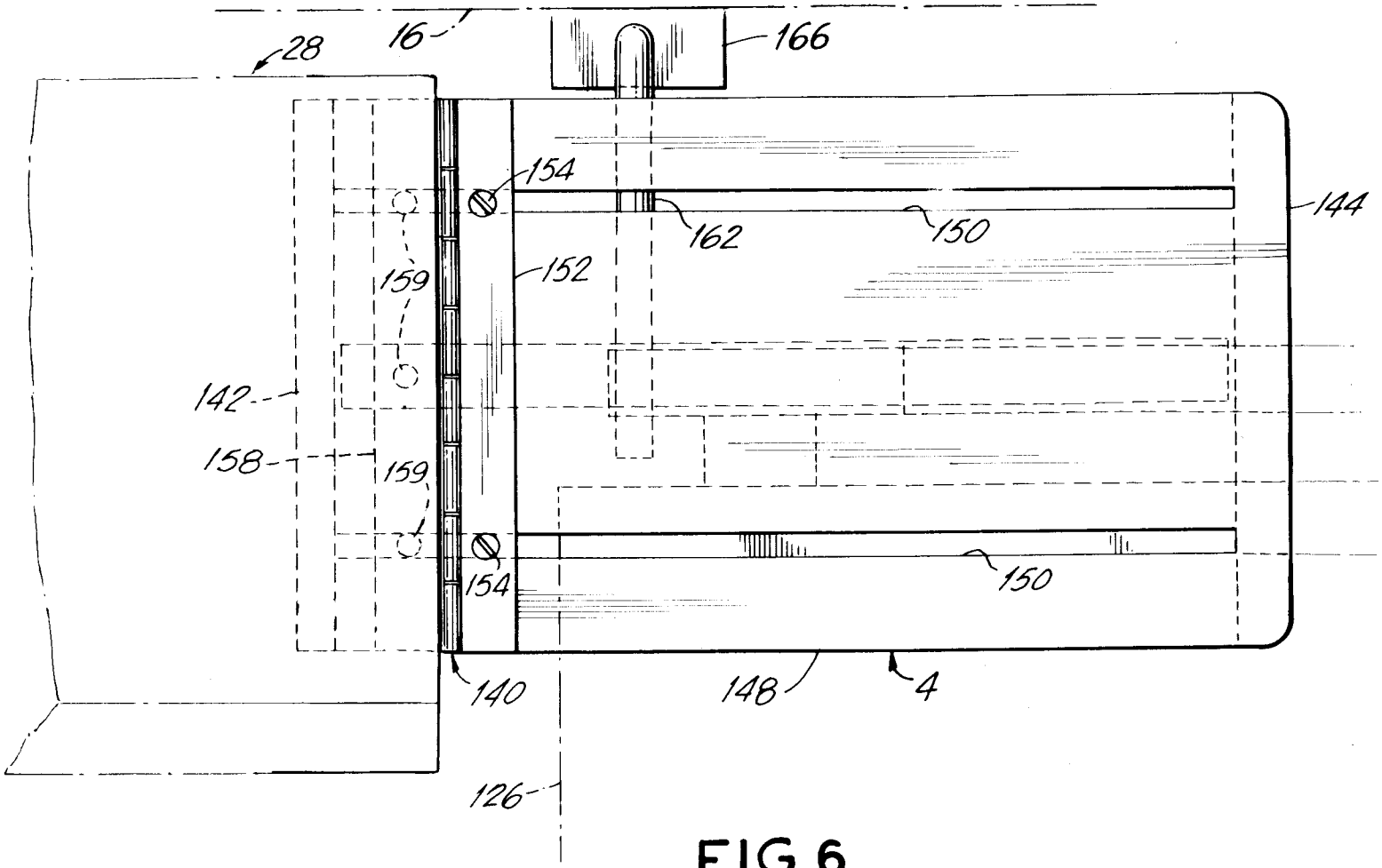
Figure 7:
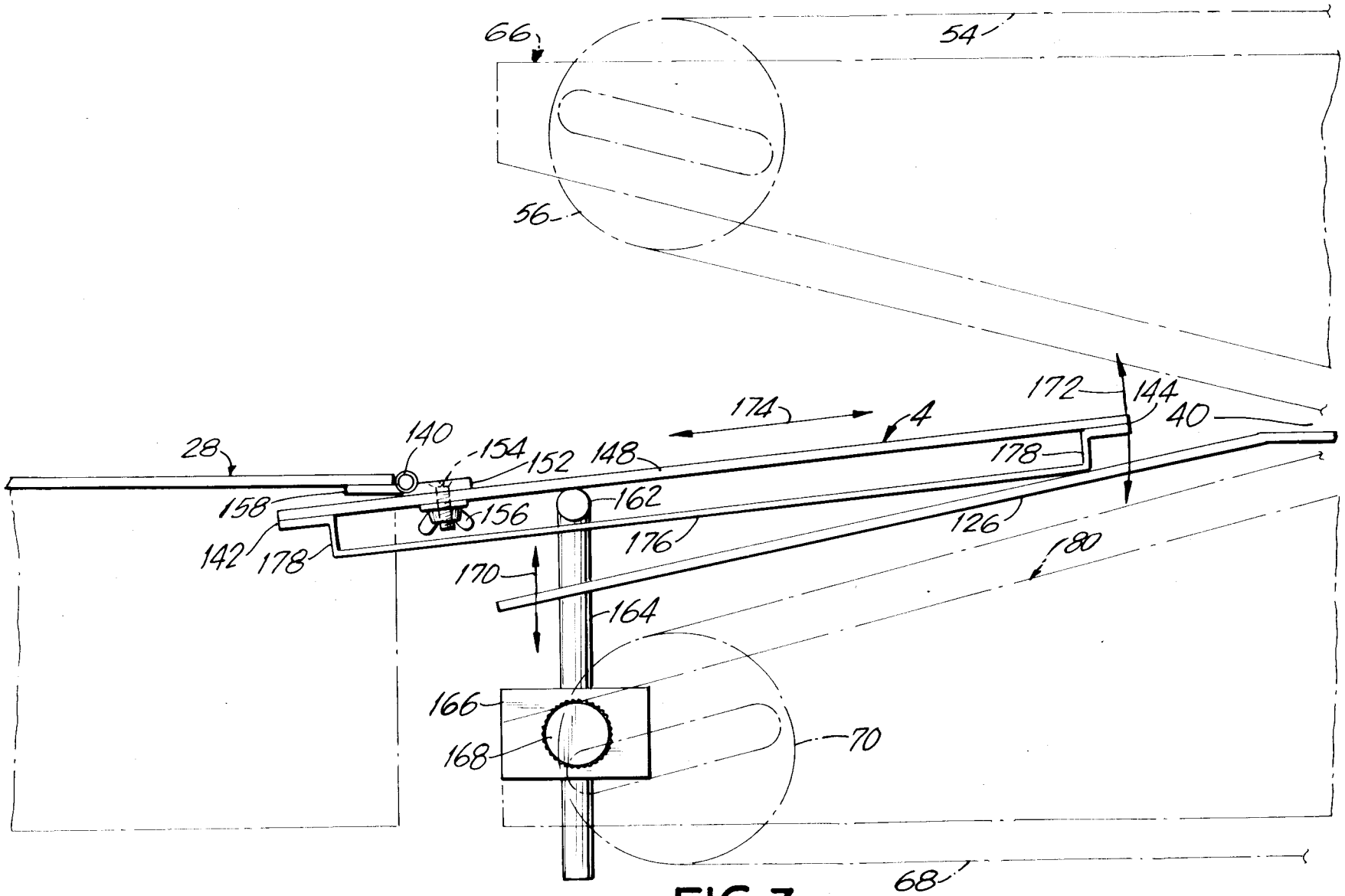
Figure 8:
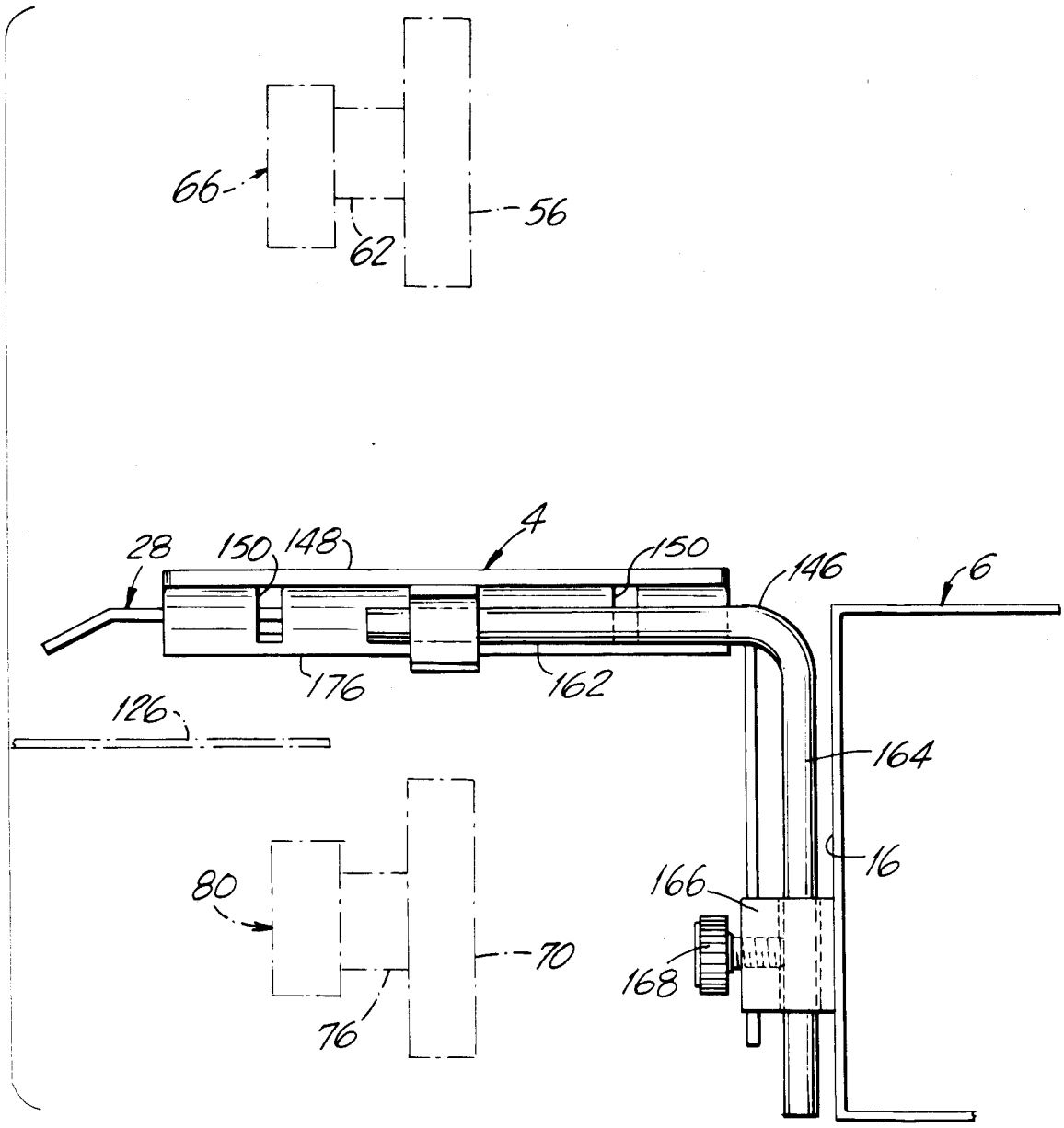

In FIGS. 6–8, adjustable leveling platform 4 is seen to have an upper surface 148 provided with two identical slots 150 therethrough, each of which runs in parallel adjacency to a respective one of the two longitudinal edges of upper surface 148 and each of which begins and ends a like short distance from the upstream and downstream lateral edges, respectively, of upper surface 148. A downstream flange 152 of hinged connection 140 is fastened to upper surface 148 at each slot 150 by a machine screw 154 passing through the slot and having a wing nut 156 threaded on its free end which is readily accessible for tightening against the underside of upper surface 148. An upstream flange 158 of hinged connection 140 is fixedly connected by flush rivets 159 to the underside of side wing 28. By this arrangement, the effective length of platform 4 between its downstream end 144 and hinged connection 140 may be adjusted by sliding the platform forward or backward under the guidance of screws 154 in slots 150 and tightening wing nuts 156 when the desired effective length of platform 4 is obtained. Preferably, hinged connection 140 is provided by a butt hinge, the flaps of which are the flanges 152 and 158.

For adjusting the pitch attitude of platform 4 about hinged connection 140, rod 146 (FIG. 5) is seen in FIG. 8 to have two coplanar arms 162, 164 at right angles to one another, one arm 162 extending slightly more than half way across the width of platform 4 perpendicularly to the parallel longitudinal sides of the platform and in underlying supporting relation to the platform. The other arm 164 extends downwardly alongside the long side 16 (FIG. 1) of work table 6 and passes through a clamp 166 fixed to side 16. Clamp 166 includes an adjustment knob 168 manually operable to clamp the arm 164 in any position of up and down movement in clamp 166. When platform 4 is moved upwardly about hinged connection 140, arm 164 moves upwardly in clamp 166; and when platform 4 is swung downwardly, arm 164 moves downwardly. The pitch attitude of platform 4 is fixed when adjustment knob 168 is tightened. In FIG. 7, arrows 170 indicate the movement of arm 164 in clamp 166 and arrows 172 indicate the resulting angular movement of platform 4 about hinged connection 140. Arrows 174 indicate the longitudinal sliding movement of platform 4 for adjusting its effective length.

To positively ensure that platform 4 will follow the up and down movements of arm 164 in clamp 166 without relying solely on the weight of the platform bearing on supporting arm 162, the supporting arm is preferably captured between platform upper surface 148 and an underlying surface 176 fixed at upstanding ends 178 thereof to the underside of the platform upper surface so as to be disposed in spaced parallel relation thereto. Underlying surface 176 and its upstanding ends 178 define an open-sided tray having the same width as platform upper surface 148 and a slightly lesser length. The open sides of the tray freely allow the effective length adjusting longitudinal sliding movement 174 of platform 4, unimpaired by supporting arm 162.

What is claimed is:

1. In a conveyorized band/trim sealing apparatus for poly bags comprising an elongated, relatively narrow rectangular work table, a motor-driven endless conveyor belt supported on rollers disposed at opposite ends of said work table, an elongated side wing fixed to said work table outboard of one longitudinal side thereof in substantially coplanar relationship with the upper run of said conveyor belt and extending substantially from the upstream end roller of the belt to a mid-length portion of said belt for supporting and guiding open top portions of a series of conveyed product-filled poly bags, each remaining portion of said bags extending laterally an equal distance onto said upper run for transport of said bags in a downstream direction, and a band sealing and trimming machine attached to said work table outboard of said one longitudinal side and downstream of said side wing, said machine having a ramp-like entrance guide plate to which said open top portions are normally transferred from said side wing for guided entry into said machine, there being a three-dimensional gap between the downstream end of said side wing and the upstream end of said guide plate which is defined by an outboard, downward and downstream offset of the guide plate upstream end from contiguous alignment with the side wing downstream end, the improvement wherein:

said apparatus further includes means for ensuring that said guided entry of said open top portions of said poly bags by said ramp-like entrance guide plate into said band sealing and trimming machine will not be adversely affected by said three-dimensional gap, said means comprising an adjustable leveling platform hingedly connected to said downstream end of said side wing to provide a downstream extension of said side wing over and beyond said gap, said platform being movable up and down about its hinged connection for adjusting its pitch attitude and for thereby bringing its downstream end in position to transfer said open top portions of successive conveyed poly bags onto said ramp-like entrance guide plate at substantially the entrance level of said band sealing and trimming machine.

2. An apparatus according to claim 1, wherein said downstream extension of said side wing provided by said adjustable leveling platform is adjustable in length.

3. An apparatus according to claim 2, wherein said hinged connection about which said platform moves up and down comprises a butt hinge, one flap of which is fixed to said side wing and the other flap of which is releasably lockable to said platform along the platform length, thereby to achieve the length adjustability of said downstream extension of said side wing by said platform.

4. An apparatus according to claim 3, wherein said other flap is releasably lockable to said platform by way of fastening means cooperating slidably with parallel, longitudinally-extending slots through the work-supporting surface of said platform.

5. An apparatus according to claim 1, wherein said platform is coupled, intermediate said downstream end thereof and said downstream end of said side wing, to said one longitudinal side of said work table by coupling means manually operable for moving said platform up and down about said hinged connection thereof and for locking said platform at any selected pitch attitude it attains in its up and down movement.

6. An apparatus according to claim 5, wherein said coupling means comprises a rod having two coplanar arms at right angles to one another, one arm extending at least partially across the width of said platform perpendicularly to parallel longitudinal sides of said platform and beneath said platform in supporting relation thereto, the other arm extending downwardly alongside said one longitudinal side of said work table and passing through a clamping device fixed to said one side, said clamping device including an adjustment knob manually operable for clamping said other arm in any position of up and down movement thereof in said clamping device.

7. An adjustable leveling platform for installation in a conveyorized band/trim sealing apparatus of the kind in which open top portions of conveyed product-filled bags remain supported on an upstream side wing of the apparatus until they are transported over a three-dimensional gap to a ramp-like entrance guide plate of a downstream band sealing and trimming machine of the apparatus, said platform comprising a rigid, planar, elongated rectangular member having a width substantially matching that of said side wing and a length substantially matching the distance between the downstream end of said side wing and the entrance of said band sealing and trimming machine, said platform being provided with two identical slots therethrough which run in parallel adjacency to respective ones of its longitudinal sides and which are adapted to receive fasteners for releasably connecting said platform to one element of a two-element hinge whose other element is to be fixed to said downstream end of said side wing, thereby to allow slot-guided sliding adjustments to be made in the effective extension of said platform from said side wing and to allow the pitch attitude of said platform extension about said hinge to be varied.

8. An adjustable leveling platform according to claim 7, including a rod having a first arm coplanar with a second arm at right angles therewith, said first arm being provided for extending laterally beneath said rectangular member in supporting relation thereto downstream of said one hinge element, said second arm passing through a manually operable clamping device to be fixed to said conveyorized band/trim sealing apparatus in a position whereat said second arm can be moved up and down and be clamped at any stage of such movement, said clamped stage determining the level of said supporting first arm and hence the pitch attitude of said platform extension about said hinge.

9. An adjustable leveling platform according to claim 8, wherein said supporting first arm of said rod, in use of said platform, is loosely captured between the underside of said rectangular member and a plate depending from said member in spaced parallel relation thereto.

10. An adjustable leveling platform for guidably supporting open top portions of conveyed product-filled poly bags from a side wing of a conveyorized band/trim apparatus to the nip of a twin-belt gripping conveyor of a band sealing and trimming machine which forms an adjustably mounted component of said apparatus, said nip being positionable to selected levels different from that of said side wing and to selected distances downstream from the downstream end of said side wing, wherein:

said adjustable leveling platform comprises a rigid elongated rectangular plate having a width substantially equal to that of said side member and a length substantially equal to the maximum selected distance of said nip from said side wing downstream end;

said plate being provided with two identical slots therethrough which run in parallel adjacency to respective ones of its longitudinal sides and which end short of its lateral sides, each slot serving to receive a fastener by which one flap of a butt hinge may be releasably fastened to and across the top of said plate at any desired position along the length of said slots;

whereby, upon fixing the other flap of said hinge to and across the underside of said side wing at the downstream end thereof, said plate can be pivoted about said hinge to bring its downstream end to any of said selected levels of said gripping conveyor nip, and the distance that said plate extends downstream towards said nip from said downstream end of said side wing can be adjusted by way of said fasteners and slots to match any of said selected distances of said nip from said side wing.

* * * * *